United States Patent [19]

Smith et al.

[11] 4,019,851

[45] Apr. 26, 1977

[54] HIGH ENERGY ARC IGNITOR FOR BURNER

[75] Inventors: Donald Arthur Smith, Haddan, Conn.; John Joseph Marshall, Feeding Hills, Mass.

[73] Assignee: Combustion Engineering, Inc., Windsor, Conn.

[22] Filed: Sept. 22, 1975

[21] Appl. No.: 615,324

[52] U.S. Cl. ..... 431/2; 431/9; 431/263; 431/264

[51] Int. Cl.[2] ..... F23Q 3/00

[58] Field of Search ..... 431/258, 9, 115, 263, 431/264, 265, 266, 2

[56] References Cited

UNITED STATES PATENTS

| | | | |
|---|---|---|---|
| 1,474,867 | 11/1923 | Walker | 431/264 X |
| 2,289,675 | 7/1942 | Ofeldt | 431/265 |
| 2,395,614 | 2/1946 | Csepely | 431/266 |
| 3,003,548 | 10/1961 | Sanders et al. | 431/265 X |
| 3,161,228 | 12/1964 | Brodlin | 431/9 |
| 3,869,244 | 3/1975 | von Linde | 431/9 X |

*Primary Examiner*—Edward G. Favors
*Attorney, Agent, or Firm*—Robert L. Olson

[57] ABSTRACT

A main burner oil gun in which hard to ignite liquid fuels can be burned, including an ignition means for the oil gun which will reliably light the oil gun time after time. The oil is sprayed from the oil gun tip in the shape of a hollow cone. Air is introduced surrounding the oil gun, and flows over a baffle plate located transversely of the oil gun, creating eddies of air, some of which break through the curtain of fuel issuing from the tip in a conical shape. This current of air that breaks through the fuel carries some fine droplets of fuel along with it, and forms a recirculation zone extending back to the oil gun tip. The ignition means is located within the hollow conical fuel flow, along the inner edge of the recirculation zone, so that the initial flame established is carried back to a point directly in front of the oil gun tip.

6 Claims, 2 Drawing Figures

HIGH ENERGY ARC IGNITOR FOR BURNER

BACKGROUND OF THE INVENTION

When burning heavy oil, such as bunker C or crude, which is difficult to ignite, an ignitor burner is generally used today which uses natural gas or No. 2 oil as the ignitor fuel. The increasing cost and decreasing availability of natural gas and No. 2 fuel oil has recently become a subject of growing concern. Thus it is desirable to reliably light off the heavy oil directly by means of a high energy spark ignitor, eliminating the need for natural gas or No. 2 fuel oil ignitors.

Even when an ignitor burner is used for lighting heavy oil main burners, it is important that the main burner fuel be ignited every time, with a stable main flame being established.

SUMMARY OF THE INVENTION

The main burner of the invention uses hard to ignite heavy oil as its fuel. This oil is discharged from the oil gun tip in the shape of a hollow cone. A transverse baffle is located around the oil gun at a position closely adjacent to the oil gun tip. Air is introduced in an envelope surrounding the oil gun. The baffle causes eddies of air to break through the conical curtain of fuel, setting up a recirculation zone back to a point directly in front on the oil gun tip. The ignition means, whether it be a high energy spark ignitor or an ignitor burner, is positioned within the cone of fuel, along the inner edge of the recirculation zone, so that the initial flame is carried back to the oil gun tip.

DESCRIPTION OF THE PREFERRED EMBODIMENT

Figure 1:
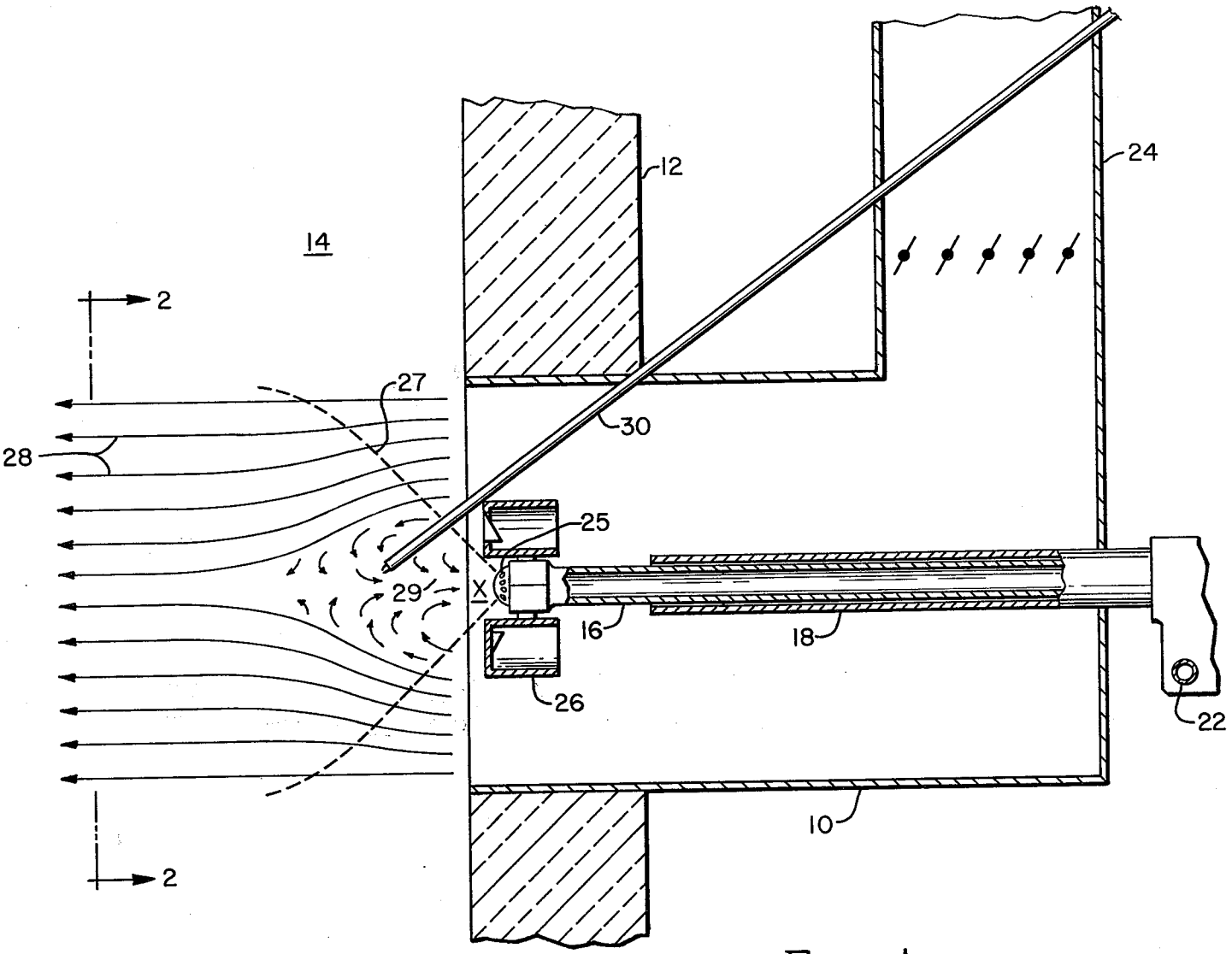
FIG. 1 is a partial sectional side view of a main oil gun and its associated ignition means.

Looking now to FIG. 1, an oil gun housing 10 extends through the wall 12 of a furnace 14. The main burner oil gun 16 extends through a guide pipe 18, which is supported within the housing 10.

Oil is supplied to the gun through port 22. Air to support combustion is supplied to the housing 10 through dampered duct 24. The oil is discharged from the oil gun tip through a plurality of openings 25, the fuel forming a hollow conical shaped curtain shown as dashed lines 27 in FIG. 1. The cone should have an included angle within the range of 60°–90°. Most of the combustion air flowing through the housing 10 enters the furnace 14 as a straight flow, shown by solid lines 28. Positioned closely adjacent to the oil gun tip and secured thereto is a transverse baffle member or diffuser 26. This baffle 26 creates turbulence in the air stream flowing thereover, causing air eddies on the downstream side thereof. Some of these air eddy currents are strong enough to break through the conical curtain of fuel oil, forming a recirculation zone 29 extending back to a point X closely adjacent to and directly in front of the burner tip.

This recirculation zone is quite stable, because the center of the fuel cone is a fairly quiescent, low pressure area, not disturbed by the majority of the air and fuel flow.

Figure 2:
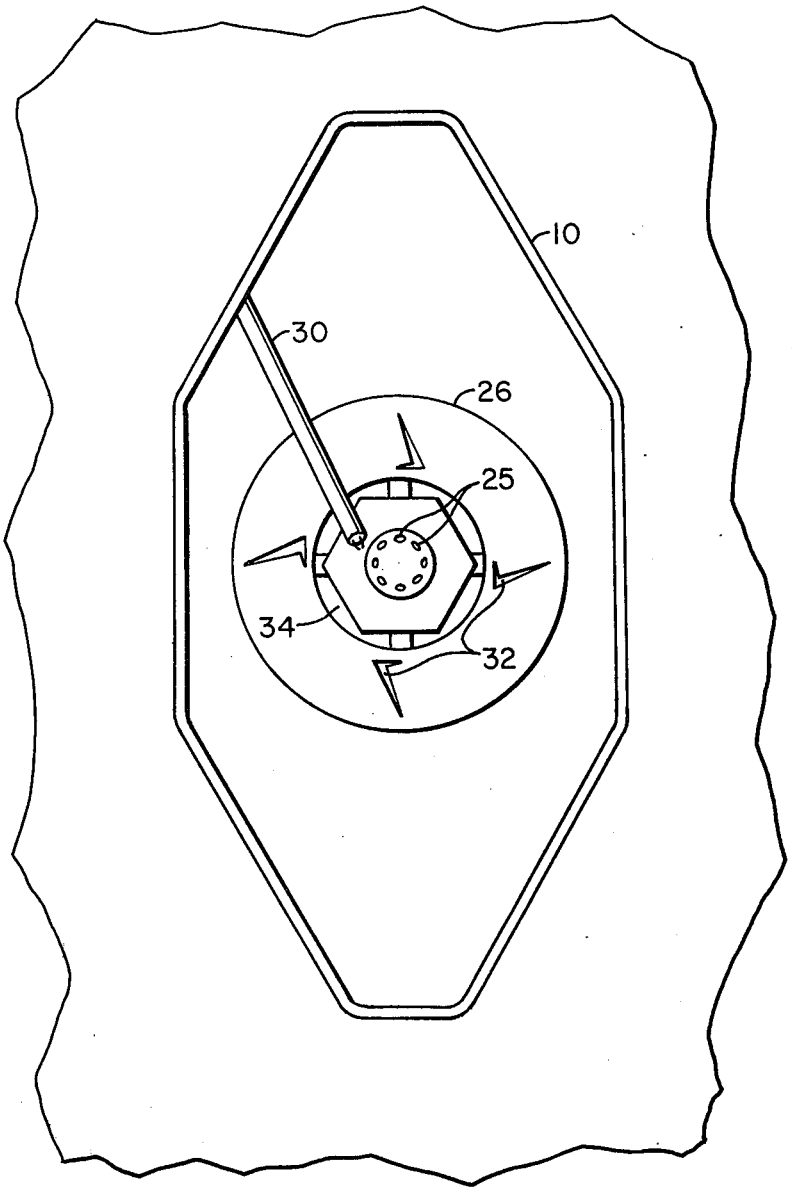
FIG. 2 is a view taken on lines 2—2 of FIG. 1.

It is along the inner edge of the recirculation zone 29 that the ignition means, shown in FIG. 1 as a high energy spark ignitor 30, is located. The recirculation zone 29 contains very fine droplets of fuel oil which break away from the conical curtain 27 as the eddy currents of air break through it. Since the air eddies are not of too high a velocity, only very small, fine droplets of oil are carried along with the air to the recirculation zone. This adds to ignition reliability since the smaller the fuel particle size, the easier it is ignited. Thus the initial flame that is established along the inner edge 29 of the recirculation zone is carried back to a point X closely adjacent to and directly in front of the oil gun tip. This flame heats up the atomized oil issuing from openings 25 until flame exists at this point. A small amount of combustion air is admitted near the tip of the oil gun through small openings 32 in the diffuser 26, and also through the annular space 34 between the oil gun tip and the inner surface of the diffuser (FIG. 2). The amount of air introduced through these openings must be kept small enough so that it does not prevent the recirculation zone 29 from being established.

From the above, it can be seen that the initial flame established is carried back towards the point at which the fuel is being discharged. Also, this initial flame is created in the most quiescent area possible, not being disturbed by either the majority of the air or the fuel flow, thus contributing to good flame stability, and reliability of ignition each time the unit is started up. Although the invention has been shown as using a high energy spark ignitor, it would also prove of value if an ignitor burner were located in the position 29 shown in FIG. 1. In either event, there is great reliability that the main burner fuel will be ignited on the initial try. The invention works equally well on steam atomized or mechanical atomizer oil burners. Because of the intense heat within the furnace 14 when it is in operation, the high energy arc ignitor 30 is retractable. In other words, once the oil gun is ignited and a flame exists, the ignitor 30 is retracted to a position outside of the furnace 14 in any well-known manner.

What is claimed is:

1. In combination, a first longitudinal pipe supplied with combustion air at its inlet end and open at its discharge end, a second pipe positioned axially within the first pipe, said second pipe being supplied at a first end with a hard to ignite liquid fuel, the second pipe having a tip at its second end containing fuel passages located such that the fuel is discharged in the shape of a hollow conical curtain, baffle means transverse to the second pipe and surrounding it adjacent to the tip such that eddy currents of air are formed on the downstream side thereof, some of the eddy currents breaking through the curtain of fuel and forming a recirculation zone having an inner edge inside the conical curtain flowing back to point directly in front of the tip of the second pipe, and ignition means positioned within the conical curtain and along the inner edge of the recirculation zone for igniting the liquid fuel.

2. The combination set forth in claim 1, including passage means through the baffle means through which a small amount of air is introduced on the downstream side of the baffle means adjacent to the tip of the second pipe.

3. The method of igniting a hard to ignite liquid fuel comprising the steps of establishing a longitudinal flow of combustion air, introducing fuel into the air flow in the shape of a hollow cone which has the same longitudinal axis as the air flow, placing a transverse baffle means in the air flow at a point longitudinally adjacent the apex of the cone, so that eddy currents of air break through the fuel cone into the center thereof, setting up a recirculation zone having an inner edge within the cone and traveling towards the apex of the cone, and positioning an ignition means along the inner edge of the recirculation zone, so that the initial flame established travels back towards the apex of the cone.

4. The method set forth in claim 3, including the step of introducing a small amount of air to the downstream side of the baffle means at a point closely adjacent to the apex of the cone.

5. The combination set forth in claim 1, wherein the ignition means is a spark ignitor.

6. The combination set forth in claim 5, wherein the baffle means includes a surface transverse to the flow of the combustion air.

* * * * *